US010288075B2

(12) United States Patent
Ishiba

(10) Patent No.: US 10,288,075 B2
(45) Date of Patent: May 14, 2019

(54) THRUST GENERATING APPARATUS FOR CONTROLLING ATTITUDE OF MOVABLE BODY

(71) Applicant: TOYOTA JIDOSHA KABUSHIKI KAISHA, Toyota-shi, Aichi-ken (JP)

(72) Inventor: Masatsugu Ishiba, Gotenba (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 246 days.

(21) Appl. No.: 15/464,463

(22) Filed: Mar. 21, 2017

(65) Prior Publication Data

US 2017/0276139 A1 Sep. 28, 2017

(30) Foreign Application Priority Data

Mar. 24, 2016 (JP) ..... 2016-059975

(51) Int. Cl.

| | |
|---|---|
| ***F04D 29/50*** | (2006.01) |
| ***F04D 19/00*** | (2006.01) |
| ***F04D 25/06*** | (2006.01) |
| ***F04D 29/32*** | (2006.01) |
| ***F04D 29/52*** | (2006.01) |
| ***F04D 29/54*** | (2006.01) |
| ***B63H 23/24*** | (2006.01) |

(Continued)

(52) U.S. Cl.

CPC ..... *F04D 19/005* (2013.01); *B63H 7/02* (2013.01); *B63H 23/24* (2013.01); *F04D 25/06* (2013.01); *F04D 25/16* (2013.01); *F04D 29/325* (2013.01); *F04D 29/522* (2013.01); *F04D 29/547* (2013.01)

(58) Field of Classification Search

CPC ..... F04D 19/005; F04D 25/16; F04D 25/06; F04D 29/547; F04D 29/522; F04D 29/325; B63H 7/02; B63H 23/24

USPC ..... 415/199.5

See application file for complete search history.

(56) References Cited

U.S. PATENT DOCUMENTS

| | | | |
|---|---|---|---|
| 1,972,780 | A | 9/1934 | Laskowitz |
| 5,343,696 | A | 9/1994 | Rohra et al. |

(Continued)

FOREIGN PATENT DOCUMENTS

| | | | |
|---|---|---|---|
| EP | 0606108 | A1 | 7/1994 |
| GB | 2303179 | A | 2/1997 |

(Continued)

OTHER PUBLICATIONS

Decision to Grant a Patent dated Jan. 30, 2018 from the Japanese Patent Office in application No. 2016-059975.

*Primary Examiner* — Hai H Huynh

(74) *Attorney, Agent, or Firm* — Sughrue Mion, PLLC

(57) ABSTRACT

A thrust generating apparatus for controlling an attitude of a movable body includes an outer shell body, a first inner shell body and a second inner shell body, a first fan rotating body and a second fan rotating body, an intermediate shell body, and a driving unit. A outer surface of the intermediate shell body has a shape such that an air flow sent from an opening end inside of any one of the first inner shell body and the second inner shell body is accommodated and flowed out to an outer flow path . When the first fan rotating body is rotated, the air flow suctioned from the outside in the axial direction of the first inner shell body passes through the outer flow path defined by the second inner shell body to be jetted from a second opening end of the outer shell body.

10 Claims, 2 Drawing Sheets

(51) Int. Cl.
*F04D 25/16* (2006.01)
*B63H 7/02* (2006.01)

(56) References Cited

U.S. PATENT DOCUMENTS

| | | | | |
|---|---|---|---|---|
| 2008/0061559 | A1 | 3/2008 | Hirshberg | |
| 2012/0213650 | A1 | 8/2012 | Lee et al. | |
| 2017/0246579 | A1 * | 8/2017 | Mun | B01D 46/0005 |

FOREIGN PATENT DOCUMENTS

| | | | |
|---|---|---|---|
| JP | 1-62895 | U | 4/1989 |
| JP | 1-277700 | A | 11/1989 |
| JP | 4-175500 | A | 6/1992 |
| JP | 06-505781 | A | 6/1994 |
| JP | 9-249120 | A | 9/1997 |
| JP | 2000-145695 | A | 5/2000 |
| JP | 2004-27858 | A | 1/2004 |
| JP | 2007-22511 | A | 2/2007 |
| JP | 2010-149662 | A | 7/2010 |
| JP | 2013-47518 | A | 3/2013 |
| JP | 2017-503950 | A | 2/2017 |
| WO | 2015/094594 | A1 | 6/2015 |

* cited by examiner

THRUST GENERATING APPARATUS FOR CONTROLLING ATTITUDE OF MOVABLE BODY

INCORPORATION BY REFERENCE

The disclosure of Japanese Patent Application No. 2016-059975 filed on Mar. 24, 2016 including the specification, drawings and abstract is incorporated herein by reference in its entirety.

BACKGROUND

1. Technical Field

The present disclosure relates to a thrust generating apparatus for controlling an attitude of a vehicle such as an automobile or the like, an aircraft, a hovercraft, a linear motor car, a ship, and other movable bodies.

2. Description of Related Art

As one of thrust generating mechanisms of a vehicle such as an automobile or the like or other movable bodies, like a propeller fan propulsion unit of an aircraft (for example, Published Japanese Translation of PCT application No. H06-505781 (JP06-505781 A) or the like), a configuration for jetting air in one direction and using a reaction force of the jetted air for thrust is employed. Such a propeller fan propulsion unit of an aircraft is configured such that rotor fins are rotated in a substantially cylindrical shell or shroud and air suctioned from one end of the shell or shroud is jetted from the other end to generate thrust toward the one end. In addition, in the movable body in which a pair of the above-mentioned thrust generating mechanisms configured to jet the air are disposed at portions equidistant from a center of gravity, as a difference is provided between the thrusts of the thrust generating mechanisms around a yaw axis, a pitch axis and/or a roll axis, a moment of changing an attitude of the movable body is obtained. Further, as disclosed in JP06-505781 A or the like, such a propeller fan propulsion unit can generate thrust in an opposite orientation when rotation of the rotor fins is inverted and the jetted air flow is reversed.

SUMMARY

As described above, a thrust generating mechanism configured to jet air can be used to control an attitude of a movable body as long as thrust is generated to produce a moment around a yaw axis, a pitch axis and/or a roll axis. In this regard, when the attitude control of the movable body around the yaw axis, the pitch axis and/or the roll axis is performed, since a configuration capable of applying a moment in two directions around the axes should be provided, it is need to generate the thrust in at least two directions, i.e., to enable the air jetting. Accordingly, there is need to provide a configuration in which at least two apparatuses having different air jetting directions are disposed around the axes in the case of the thrust generating apparatus having a configuration for jetting the air in only one direction or a configuration in which at least two apparatuses having different air jetting directions are disposed at disposition areas in the case of a pair of thrust generating mechanisms disposed at areas equidistant from the center of gravity of the movable body, or there is a need to use an apparatus capable of generating reverse thrust by rotating rotor fins in reverse. However, when the above-mentioned two or more thrust generating apparatuses are disposed around the axes or at the disposition areas, the weight of the entire movable body is increased to that extent, and further, dimensions of the entire movable body are also increased. Meanwhile, in the one thrust generating apparatus, in the case of the mechanism configured to rotate the rotor fins in reverse to generate reverse thrust, it is difficult to uniformly control thrust in a normal direction (thrust when the movable body advances) and reverse thrust in a reverse direction, and further, upon reverse rotation of the rotor fins, loss of thrust obtained by jetting air may be relatively increased due to design, adjustment, or the like, in optimization of loss of thrust upon generation of thrust in a normal direction.

The present disclosure provides a thrust generating apparatus for jetting air used for attitude control of a movable body, which is capable of generating thrusts in opposite orientations using one apparatus, suppressing an increase in weight of the movable body, and enabling easy control of intensity of thrusts in opposite orientations.

In an aspect of the present disclosure, a thrust generating apparatus for controlling an attitude of a movable body includes a cylindrical outer shell body having a first opening end and a second opening end formed at both ends in an axial direction of the outer shell body; a first inner shell body and a second inner shell body, the first inner shell body having a cylindrical shape shorter than and with a diameter smaller than that of the outer shell body and disposed inside the first opening end, the second inner shell body having a cylindrical shape shorter than and with a diameter smaller than that of the outer shell body and disposed inside the second opening end, the first inner shell body and the second inner shell body defining an outer flow path between an outer surface thereof disposed at the outer shell body side and an inner wall of the outer shell body; a first fan rotating body and a second fan rotating body disposed inside the first inner shell body and the second inner shell body, respectively, the first fan rotating body and the second fan rotating body being configured to suction an air flow from an outside in the axial direction to send the air flow toward an inside in the axial direction upon rotation and driving thereof; an intermediate shell body having a diameter smaller than that of the outer shell body and disposed between the first inner shell body and the second inner shell body in the outer shell body, the intermediate shell body defining an intermediate flow path between an outer surface thereof disposed at the outer shell body side and the inner wall of the outer shell body, and the outer surface having a shape such that the air flow sent from an opening end inside in the axial direction of one of the first inner shell body and the second inner shell body is accommodated and flowed out to the outer flow path defined between the other one of the first inner shell body and the second inner shell body and the outer shell body; and a driving unit configured to rotate each of the first fan rotating body and the second fan rotating body. When the first fan rotating body is rotated, the air flow suctioned from the outside in the axial direction of the first inner shell body passes through the outer flow path defined by the second inner shell body to be jetted from the second opening end of the outer shell body. When the second fan rotating body is rotated, the air flow suctioned from the outside in the axial direction of the second inner shell body passes through the outer flow path defined by the first inner shell body to be jetted from the first opening end of the outer shell body.

In the above-mentioned apparatus of the present disclosure, when the fan rotating body of the one opening end side of the outer shell body is rotated, the air flow suctioned from the fan rotating body passes through a space between the inner wall of the outer shell body of the opposite side in the axial direction of the outer shell body and the outer wall of the inner shell body to be jetted from the other opening end of the outer shell body, and symmetrically thereto, when the fan rotating body of the other opening end side of the outer shell body is rotated, the air flow suctioned from the fan rotating body passes through the space between the inner wall of the outer shell body of the opposite side in the axial direction of the outer shell body and the outer wall of the inner shell body to be jetted from the one opening end of the outer shell body. That is, according to the above-mentioned configuration, since the air flow can be selectively jetted in two axial opposite directions using one apparatus, there is no need to use two or more of the same apparatuses in generation of thrusts in two directions for application of the moment of controlling an attitude of the movable body, and further, the dimensions thereof can also be relatively reduced. Accordingly, an increase in space occupied by the thrust generating mechanism configured to control an attitude of the movable body and an increase in weight of the entire movable body can be suppressed.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1A:
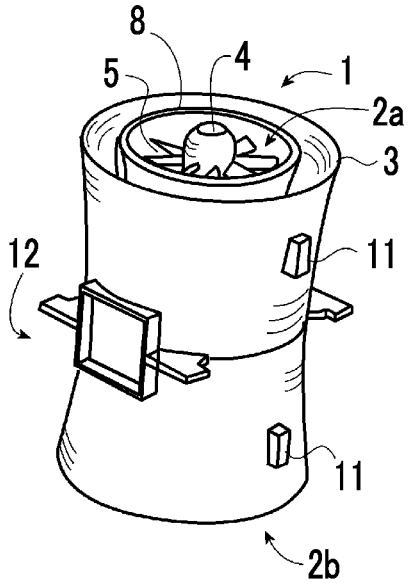
FIG. 1A is a schematic perspective view of an embodiment of an air jetting type thrust generating apparatus according to the present disclosure.

Hereinafter, an embodiment of the present disclosure will be described with reference to the accompanying drawings. The same reference numerals in the drawings designate the same parts.

In the present disclosure, "a movable body" may be, typically, a movable body that is movable while floating in the air, for example, a flyable vehicle, an aircraft, or the like, or may be an arbitrary movable body that travels or moves in circumstances in which an attitude can be controlled by an aerodynamic force, for example, a vehicle such as an automobile or the like, a hovercraft, a linear motor car, a ship, or the like. "A fan rotating body" may be an arbitrary type fan rotating body in which rotor blades are provided at a rotor main body and rotated by a driving apparatus, air is suctioned from the outside in the axial direction of an outer shell body when the rotor blades are rotated, and the air suctioned inward in the axial direction of the outer shell body is sent out as an air flow. "A driving unit," i.e., a rotating apparatus (means), may be a rotary type actuator such as an electric motor, an air drive impulse turbine, or the like. "The driving unit" may be controlled by "a rotation control unit" of an arbitrary type to rotate selectively one of fan rotating bodies disposed inside opening ends of both sides of the outer shell body having a cylindrical shape.

Referring to FIG. 1 and FIG. 2, a configuration of the apparatus will be described. A thrust generating apparatus 1 according to the embodiment has air flow generating mechanisms 2*a* and 2*b* installed at a first opening end 3*a* and a second opening end 3*b* of both ends of a cylindrical outer shell body 3 and configured to suction air from the outside and send the air flow toward the inside of an outer shell body 3. Hereinafter, when the first opening end 3*a* and the second opening end 3*b* are generally designated, they are simply referred to as the opening ends 3*a* and 3*b*. The thrust generating apparatus 1 has a configuration in which an intermediate shell body 7 having a smaller diameter than the outer shell body 3 is fixed to a central region of the outer shell body 3 in the outer shell body 3 via a support frame 7*a*. The thrust generating apparatus 1 has a configuration in which the outer shell body 3, the air flow generating mechanisms 2*a* and 2*b* and the intermediate shell body 7 are disposed substantially coaxially with a central axis Ce of the outer shell body 3 and symmetrical with respect to the axis Ce, and further, may have a shape and a configuration in which they are substantially surface-symmetrical with respect to a symmetrical surface ID-ID perpendicular to the central axis Ce.

In each of the air flow generating mechanisms 2*a* and 2*b*, a cylindrical inner shell body 8 shorter than and having a smaller diameter than the outer shell body 3 is fixed to the outer shell body 3 via a support frame 8*a*, and further, a fan rotating body 4 is attached to the inside of the inner shell body 8. The inner shell body 8 and the fan rotating body 4 installed at the air flow generating mechanism 2*a* are referred to as a first inner shell body and a first fan rotating body, and the inner shell body 8 installed at the air flow generating mechanism 2*b* is referred to as a second inner shell body and a second fan rotating body. The first inner shell body and the second inner shell body as well as the first fan rotating body and the second fan rotating body are configured to be symmetrical with respect to the symmetrical surface ID-ID, and in the following description, these will be described as the inner shell body 8 and the fan rotating body 4. The fan rotating body 4 has a plurality of fins 5 in a circumferential direction in the same aspect as a configuration of a conventional air blower, and is connected to a shaft 6*a* of an electric motor 6 installed at the intermediate shell body 7. The electric motor 6 is an example of a driving unit. The driving unit is not limited thereto but may be an air drive impulse turbine or the like. When the electric motor 6 is rotated, as schematically shown in FIG. 1C and FIG. 1E, the fan rotating body 4 is rotated in a direction of an arrow in the drawings, and thus an air flow is suctioned from the outside in the axial direction of the inner shell body 8 and sent to the inside in the axial direction, i.e., from above to below at the first opening end 3*a* side in FIG. 1B, and from below to above at the second opening end 3*b* side. Rotation control of the electric motor 6 is performed by, for example, a control apparatus (a rotation control unit) disposed inside the intermediate shell body 7. While not shown, a signal line and a power line may be mounted in the control apparatus of the intermediate shell body 7 via an operation port 12 from the outside of the outer shell body 3 in an arbitrary aspect. Further, a rectification fixing fin 10 configured to rectify the air flow from the fan rotating body 4 may be disposed between the fan rotating body 4 and the electric motor 6.

Figure 1B:
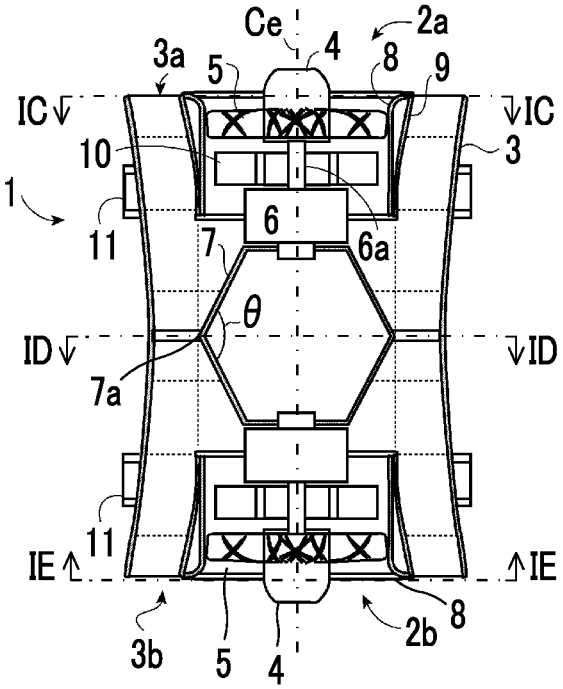
FIG. 1B is a schematic cross-sectional view in an axial direction of the embodiment of the air jetting type thrust generating apparatus according to the present disclosure.
Figure 2A:
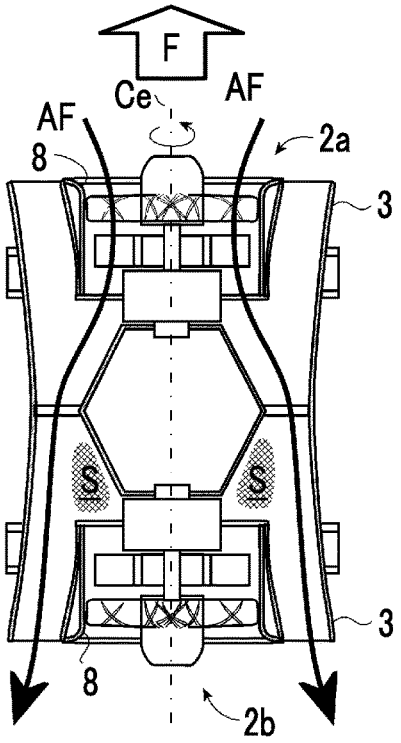
FIG. 2A is a schematic cross-sectional view showing one air flow upon actuation of the apparatus of the embodiment corresponding to FIG. 1B.
Figure 2B:
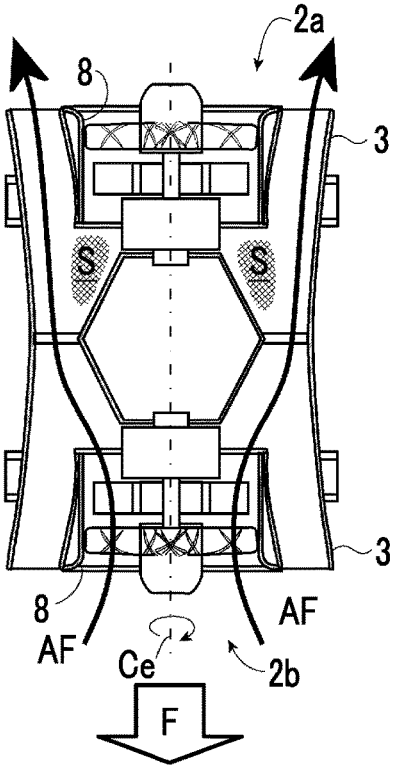
FIG. 2B is a schematic cross-sectional view showing another air flow upon the actuation of the apparatus of the embodiment corresponding to FIG. 1B.

In the outer shell body 3, as schematically shown in FIG. 2A and FIG. 2B, an air flow path Fo is defined such that an air flow moves toward the other side from the first opening end 3*a* and the second opening end 3*b* of both ends, passes through a path (an intermediate flow path) between an outer surface of the intermediate shell body 7 and an inner wall of the outer shell body 3 and a path (an outer flow path) between an outer wall 9 of the inner shell body of the opposite side and the inner wall of the outer shell body 3 from the fan rotating body 4 inside the inner shell body 8, and exits through the second opening end 3*b* and the first opening end 3*a* of the opposite side. Further, as described above, in the thrust generating apparatus 1 according to the embodiment, since a structure that is surface-symmetrical with respect to the symmetrical surface ID-ID is provided, the flow path Fo of the air flow is also defined to be surface-symmetrical with respect to the symmetrical surface ID-ID. In this way, since the intermediate shell body 7 disposed between the inner shell bodies 8 defines a portion (an intermediate flow path) of the flow path Fo and a function of deviating an air flow AF is exhibited, an exterior of the intermediate shell body 7 has a shape in which the air flow sent from an opening end inside in the axial direction of the inner shell body 8 of one side is received and flows out to the outer flow path defined between the inner shell body 8 of the other side and the outer shell body 3. Specifically, as shown in FIG. 1B, the intermediate shell body 7 has a shape that is rotationally symmetrical with respect to an axis of the outer shell body 3, and includes an area 7*a* having a maximum diameter with respect to a diameter in a direction perpendicular to the axis Ce direction. The intermediate shell body 7 is formed such that a diameter in a direction perpendicular to the axis Ce direction is decreased from the symmetrical surface ID-ID serving as the area 7*a* having a maximum diameter toward the outside in the direction of the axis Ce. Further, the intermediate shell body 7 is formed such that a diameter at the symmetrical surface ID-ID of the intermediate shell body 7 is larger than an opening diameter inside in the direction of the axis Ce of the inner shell body 8 and a diameter of an end portion outside in the direction of the axis Ce of the intermediate shell body 7 is smaller than an opening diameter inside in the direction of the axis Ce of the inner shell body 8. According to such a configuration of the intermediate shell body 7, when the air flow AF sent from the fan rotating body 4 to pass through fixing fin 10 reaches the intermediate shell body 7, the air flow AF deviates along the surface of the intermediate shell body 7 and advances toward the outside farther than the inner shell body 8 of the opposite side. In addition, an angle θ formed by portions of sides that surround the symmetrical surface ID-ID (a portion serving as a maximum diameter of the intermediate shell body 7) in a cross-sectional shape along the axis of the intermediate shell body 7 is an angle in which the air flow AF flows as it deviates. Accordingly, in the air flow AF that reaches the symmetrical surface ID-ID, an element toward the fan rotating body 4 of the opposite side is suppressed to as small a level as possible. In particular, when the angle θ is an angle at which the air flow AF is separated from the surface of the intermediate shell body 7 and flows after passing through the symmetrical surface (as shown in FIG. 2A and FIG. 2B, a separated region S is formed in the vicinity of the surface of the intermediate shell body 7 of a downstream side of the symmetrical surface ID-ID), because the air flow advances along the inner wall of the outer shell body 3, it is advantageous for the element toward the fan rotating body 4 of the opposite side to be largely reduced. A specific size of the angle θ formed by the portions of the sides that surround the symmetrical surface ID-ID of the intermediate shell body 7 can be seen in, for example, an experiment.

As shown in the drawings, the outer shell body 3 is formed from the symmetrical surface ID-ID toward the first opening end 3*a* and the second opening end 3*b* away from the axis Ce. Thus the flow path Fo (outer flow path) defined between the outer shell body 3 and the outer wall 9 of the inner shell body 8 extends from the symmetrical surface ID-ID toward the first opening end 3*a* and the second opening end 3*b* away from the axis Ce in the radial direction. According to the above-mentioned configuration, first, the air flow AF after passing through the symmetrical surface is likely to advance along the outer shell body 3 as it is, and contributes to reduction of an element toward the fan rotating body 4 of the opposite side (toward the axis Ce). In addition, since the air flow AF advances while slightly widening in the radial direction when the air flow AF is jetted from the first opening end 3*a* or the second opening end 3*b*, a flow velocity of the air flow can be returned to atmospheric pressure rapidly after jetting, and influence on the air flow of the downstream side of the outer shell body 3 can be reduced.

According to the above-mentioned thrust generating apparatus 1, as schematically shown in FIG. 2A and FIG. 2B, the air flow AF is suctioned and jetted in both directions (upward and downward directions of the drawings) of the axis Ce of the outer shell body 3 using one apparatus, and thus a thrust F can be generated. In addition, as described above, when the thrust generating apparatus 1 is formed in a structure that is surface-symmetrical with respect to the symmetrical surface ID-ID and the air flow path Fo is also defined as having surface symmetry, the same air flow AF can be easily formed in both directions of the axis Ce. Then, as described in relation with the configuration of the outer shell body 3 and the intermediate shell body 7, in the air flow AF flowing through the flow path Fo from the fan rotating body 4 of the one side to the opening ends 3*a* and 3*b* of the other side, as the element flowing into the fan rotating body 4 of the opposite side is suppressed to as low a level as possible, loss of the air flow can be suppressed to a lower level and the air flow AF from the fan rotating body 4 to the opening ends 3*a* and 3*b* of the opposite side can be efficiently jetted. As a result, the air flow or the output required from each of the fan rotating bodies 4 can also be reduced, and a dimension of the fan rotating body 4 (a diameter of the fan rotating body 4) can be decreased.

Figure 1C:
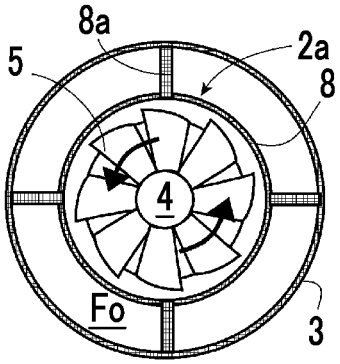
FIG. 1C is a schematic cross-sectional view taken along surface IC-IC of FIG. 1B.
Figure 1D:
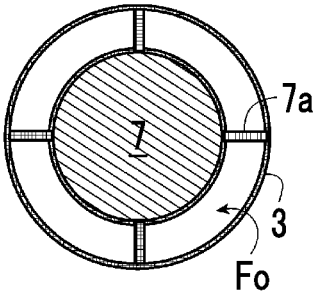
FIG. 1D is a schematic cross-sectional view taken along surface ID-ID of FIG. 1B.
Figure 1E:
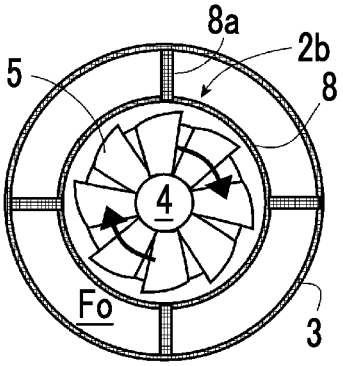
FIG. 1E is a schematic cross-sectional view taken along surface IE-IE of FIG. 1B.
Figure 3:
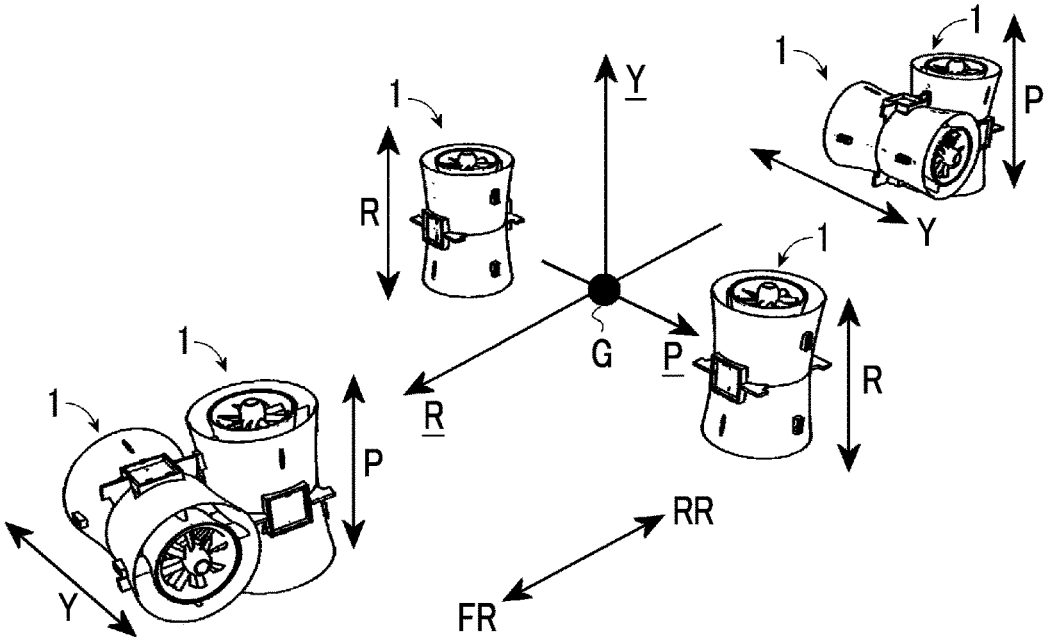
FIG. 3 is a view showing a disposition configuration of the thrust generating apparatus when disposed at a movable body in order to control an attitude of the movable body of one embodiment of the air jetting type thrust generating apparatus according to the present disclosure.

The thrust generating apparatus 1 according to the embodiment exemplified in FIG. 1A can be used to generate the thrust to apply a moment for controlling an attitude of the movable body. In order to fix the thrust generating apparatus 1 to the movable body, an attachment means 11 may be appropriately provided at the outer surface of the outer shell body 3. In the attitude control of such a movable body, the moment is preferably applied around an axis of each of the yaw direction, the pitch direction and the roll direction, in the thrust generating apparatuses 1. As schematically shown in FIG. 3, the pair of thrust generating apparatuses 1 are disposed at positions equidistant from a center of gravity G of the movable body with respect to a yaw axis Y, a pitch axis P and a roll axis R such that the axes Ce are directed in directions around the yaw axis Y, the pitch axis P and the roll axis R. Specifically, for example, in the pitch direction, the pair of thrust generating apparatuses 1 may be disposed in front and rear of the movable body (in FIG. 3, forward/rearward direction shown by arrows FR and RR) using the axis Ce as a vertical orientation, and in the roll direction, the pair of thrust generating apparatuses 1 may be disposed at left and right sides of the movable body using the axis Ce as the vertical orientation. In the yaw direction, the pair of thrust generating apparatuses 1 may be disposed in front and rear of the movable body using the axis Ce as a lateral orientation perpendicular to the forward/rearward direction of the movable body or at left and right sides of the movable body using the axis Ce as a lateral orientation (not shown) in the forward/rearward direction of the movable body. According to such a configuration, as each of the thrust generating apparatuses 1 generates thrust, in the movable body, a yaw moment, a pitch moment and/or a roll moment are applied.

Further, in the case of the thrust generating apparatus 1 according to the embodiment, since the thrust can be selectively generated in both directions of the axis Ce using one apparatus, an increase in weight can be suppressed in comparison with the case in which two apparatuses configured to generate thrust in only one direction at each area of the movable body are installed to perform the same action. In addition, in the case in which the two thrust generating apparatuses are installed, when one of the thrust generating apparatuses does not generate the thrust, if a useless air flow passes therefrom, since an influence may be exerted on a lifting force of the movable body, a mechanism configured to close the air flow may be installed at the thrust generating apparatus that does not generate the thrust. For this reason, when two apparatuses configured to generate the thrust in only one direction are installed, any one of the apparatuses should always be closed, and two mechanisms configured to close such an air flow are prepared. As a result, the total weight of the thrust generating apparatuses is increased to that extent. Meanwhile, in the case of the present disclosure, since the one thrust generating apparatus 1 is provided at each area of the movable body, a mechanism configured to close the air flow may also be provided for the one thrust generating apparatus 1, and even in this regard, an increase in weight is suppressed.

Actuation of the apparatus will be described with reference to FIG. 2A and FIG. 2B. In actuation of the thrust generating apparatus 1 according to the embodiment exemplified in FIGS. 1A to 1E, any one of the air flow generating mechanisms 2*a* and 2*b* provided at the opening ends 3*a* and 3*b* of the outer shell body 3 is selectively driven, and the thrust F is generated in any one direction along the axis Ce of the outer shell body 3. Specifically, as exemplified in FIG. 2A, when the thrust F is generated from below to above in the drawing, the fan rotating body 4 is rotated by the air flow generating mechanism 2*a* as shown in FIG. 1C, and as exemplified in FIG. 2B, when the thrust F is generated from above to below in the drawing, the fan rotating body 4 is rotated by the air flow generating mechanism 2*b* as shown in FIG. 1E. In the thrust generating apparatus 1 according to the embodiment, separate air flow generating mechanisms are driven in the case in which the thrust F in a downward orientation is generated and the case in which the thrust F in an upward orientation is generated. Therefore, switching of the directions of the air flows can be accomplished in a relatively short time, and an influence of interference between the air flows is reduced. Accordingly, a thrust generation response is improved. Further, in the attitude control of the movable body, as described with reference to FIG. 3, in the case in which thrusts in opposite orientations are generated in the pair of thrust generating apparatuses 1 when a moment around a certain axis is generated, while a moment around the center of gravity is generated, the thrust that displaces the center of gravity cannot be substantially applied. Accordingly, attitude control of the movable body independent from thrust control (acceleration/deceleration control) for advance of the movable body can be performed.

While the following description is related to the embodiment, the present disclosure is not limited to only the exemplified embodiment but may be applied to various apparatuses without departing from the concept of the present disclosure.

The present disclosure can also be expressed as described below. A thrust generating apparatus for controlling an attitude of a movable body of an aspect is accomplished by an apparatus including an outer shell body serving as a cylindrical outer shell body and having opening ends at both ends in an axial direction thereof, cylindrical inner shell bodies disposed inside the opening ends and shorter than and having a smaller diameter than the outer shell body configured to define an outer flow path between an outer surface of the inner shell body and an inner wall of the outer shell body, fan rotating bodies disposed inside the inner shell bodies and configured to suction an air flow from the outside in the axial direction of the inner shell bodies and send the air flow to the inside in the axial direction when the fan rotating bodies are rotated, an intermediate shell body disposed between the inner shell bodies at both ends in the outer shell body, having a smaller diameter than the outer shell body, configured to define an intermediate flow path between an outer surface thereof and an inner wall of the outer shell body, and having a shape configured to accommodate the air flow sent from an opening end inside in the axial direction of the inner shell bodies of one side and discharge the air flow to an outer flow path defined between the inner shell bodies of the other side and the outer shell body, and a means configured to rotate the fan rotating bodies, wherein, when any one of the fan rotating bodies are rotated, the air flow suctioned from the outside in the axial direction of the inner shell body in which the fan rotating body is disposed passes through the outer flow path of the inner shell body disposed outside the other fan rotating body to be jetted from the opening end of the outer shell body.

In the above-mentioned aspect, any one of the outer shell body, the inner shell body, and the intermediate shell body may be formed in a structure that is surface-symmetrical with respect to a surface perpendicular to the direction of the axis of the cylindrical outer shell body (a symmetrical surface). That is, in the above-mentioned aspect, the outer shell body may have a shape that is substantially surface-symmetrical with respect to the symmetrical surface perpendicular to the direction of the axis, the inner shell body of both ends of the outer shell body may be disposed to be substantially surface-symmetrical with respect to the symmetrical surface, and the intermediate shell body may have an exterior that is substantially surface-symmetrical with respect to the symmetrical surface. According to the above-mentioned configuration, adjustment for jetting the same air flow in both axial directions is relatively easy. Further, the above-mentioned surface symmetry is not limited to perfect surface symmetry but may be surface symmetry with precision in an allowable range as long as a function of jetting the same air flow in both axial directions is accomplished.

In the above-mentioned aspect, the inner shell body may be disposed substantially coaxially with the outer shell body. According to the above-mentioned configuration, a flow velocity of the air flow passing through the outer flow path between the outer shell body and the inner shell body and jetted from the opening end is substantially equal around the axis of the outer shell body, the thrust is generated substantially along the axis of the outer shell body, and adjustment of the thrust or the moment for attitude control is easy. Further, the above-mentioned coaxial disposition is not limited to perfect coaxial disposition but may be coaxial disposition with precision in an allowable range as long as a function of substantially equalizing the flow velocity of the air flow around the axis of the outer shell body is accomplished.

In the above-mentioned aspect, one of the configurations capable of selectively ejecting the air flow in two opposite axial directions is the intermediate shell body, and the intermediate shell body may be configured such that the air flow suctioned from the fan rotating body at a central region of the one opening end of the outer shell body deviates outside the inner shell body while the air flow advances to the opening end of the opposite side of the outer shell body. According to the above-mentioned configuration, since the air flow flows to avoid the fan rotating bodies to be jetted from the opening end, loss of a fluid can be suppressed to a low level. More specifically, the intermediate shell body may have a rotation-symmetrical shape with respect to the axis of the outer shell body, and a diameter in the direction perpendicular to the axial direction of the intermediate shell body may be formed to be reduced from an area having a maximum diameter toward the outside in the axial direction. Further, when the intermediate shell body has a shape that is surface-symmetrical with respect to the "symmetrical surface," "an area having a maximum diameter" is present on the symmetrical surface. According to such a configuration, the air flow suctioned from the fan rotating body advances through the outer shell body to appropriately deviate away from the axis of the outer shell body in the radial direction. In addition, more preferably, a diameter in the area having the maximum diameter of the intermediate shell body (or the symmetrical surface) may be larger than a bore diameter of the opening end inside in the axial direction of the inner shell body, a diameter of the end portion outside in the axial direction of the intermediate shell body may be smaller than a bore diameter of the opening end inside in the axial direction of the inner shell body, and thus some of the air flow suctioned from the fan rotating body of the one side can be suppressed from passing through the fan rotating body of the other side. Further, in order for the air flow passing through the area having the maximum diameter in the cross-sectional shape along the axis of the intermediate shell body (or the symmetrical surface) to be returned toward the axis as little as possible, the intermediate shell body may be formed such that the angle formed by the sides that surround the area having the maximum diameter (or the symmetrical surface) in the cross-sectional shape along the axis is an angle at which the air flow from any one side of the inner shell body flows to deviate toward the outside of the other side of the inner shell body. In this regard, in order for the air flow passing through the area having the maximum diameter (or the symmetrical surface) in the cross-sectional shape along the axis of the intermediate shell body to more securely pass through the outside of the inner shell body, the intermediate shell body may be formed such that the angle formed by the sides that surround the area having the maximum diameter (or the symmetrical surface) in the cross-sectional shape along the axis is an angle at which the air flow from any one side of the inner shell body flows away from the surface of the intermediate shell body after passing through the area having the maximum diameter (or the symmetrical surface). When the air flow is away from the surface of the intermediate shell body after passing through the area having the maximum diameter (or the symmetrical surface), an element of the air flow flowing along the surface of the intermediate shell body is largely reduced, and thus a flow rate of the air flow passing through the fan rotating body and jetted can be largely reduced.

In the above-mentioned aspect, the outer flow path defined between the outer shell body and the inner shell body at both ends of the outer shell body may extend away from the axis in the radial direction toward the outside in the axial direction. According to such a configuration, the air flow can be further suppressed from approaching in the axial direction after passing the symmetrical surface, the flow velocity of the air flow jetted from the outer shell body can be rapidly returned to atmospheric pressure after jetting, and an influence on the air flow downstream from the outer shell body can be reduced. In addition, in the above-mentioned aspect, the bore diameter of the opening ends of both ends of the outer shell body may be larger than the bore diameter of the portion between both ends of the outer shell body, and the bore diameter of the opening end outside in the axial direction of the inner shell body may be larger than the bore diameter of the opening end inside in the axial direction of the inner shell body.

As described above, according to the present disclosure, as the mechanisms configured to perform suction of an air flow and transmission in one direction to generate thrust are installed at both ends of the cylindrical outer shell body, a structure capable of selectively generating thrust in two opposite directions on the same axis is provided. In the above-mentioned configuration, since transmission of the air flow in the directions is achieved without performing inversion of rotation of the fan rotating body and/or inversion of an orientation of the air flow in the same flow path, loss of a fluid can be reduced in comparison with the configuration in which inversion of rotation of the fan rotating body and/or inversion in an orientation of the air flow in the same flow path is performed. Accordingly, since an output required from the fan rotating body and a rotary driving means (an electric motor or the like) thereof can also be reduced, dimensions of these configurations can also be reduced. In addition, since means configured to generate an air flow in the two directions are separate and switching of the directions of the air flows can be achieved by switching the drive of the fan rotating bodies, for example, in comparison with the configuration in which rotation of the fans is reversed, it is also advantageous for switching of the directions of the air flow to be able to be accomplished in a short time (in the case of the configuration in which rotation of the fans is reversed, when switching of the directions of the air flow is performed, a time for returning a rotational speed of the fans to 0 is needed.).

The apparatus of the above-mentioned aspect is, as also disclosed in the embodiment, advantageous for use in attitude control of the movable body. In the case of the configuration of the related art, for example, in an aircraft, when attitude control is performed by the thrust generating means, in the two thrust generating means disposed equidistant from the center of gravity in the movable body, because a technique of applying a moment according to a difference in thrusts of the two thrust generating means is provided while applying the thrust moved in the forward/ rearward direction, the thrust is always applied to the center of gravity. However, in the case of the present disclosure, according to the configuration in which the two thrust generating apparatuses are disposed equidistant from the center of gravity in the movable body, because the thrusts in the opposite orientations are generated, control such as generation of a moment for attitude control is possible without substantially applying the thrust to the center of gravity.

What is claimed is:

1. A thrust generating apparatus for controlling an attitude of a movable body, the thrust generating apparatus comprising:

a cylindrical outer shell body having a first opening end and a second opening end formed at both ends in an axial direction of the outer shell body;

a first inner shell body and a second inner shell body, the first inner shell body having a cylindrical shape shorter than and with a diameter smaller than that of the outer shell body and disposed inside the first opening end, the second inner shell body having a cylindrical shape shorter than and with a diameter smaller than that of the outer shell body and disposed inside the second opening end, the first inner shell body and the second inner shell body defining an outer flow path between an outer surface thereof disposed at the outer shell body side and an inner wall of the outer shell body;

a first fan rotating body and a second fan rotating body disposed inside the first inner shell body and the second inner shell body, respectively, the first fan rotating body and the second fan rotating body being configured to suction an air flow from an outside in the axial direction to send the air flow toward an inside in the axial direction upon rotation and driving thereof;

an intermediate shell body having a diameter smaller than that of the outer shell body and disposed between the first inner shell body and the second inner shell body in the outer shell body, the intermediate shell body defining an intermediate flow path between an outer surface thereof disposed at the outer shell body side and the inner wall of the outer shell body, and the outer surface having a shape such that the air flow sent from an opening end inside in the axial direction of one of the first inner shell body and the second inner shell body is accommodated and flowed out to the outer flow path defined between the other one of the first inner shell body and the second inner shell body and the outer shell body; and a driving unit configured to rotate each of the first fan rotating body and the second fan rotating body, wherein, when the first fan rotating body is rotated, the air flow suctioned from the outside in the axial direction of the first inner shell body passes through the outer flow path defined by the second inner shell body to be jetted from the second opening end of the outer shell body, and when the second fan rotating body is rotated, the air flow suctioned from the outside in the axial direction of the second inner shell body passes through the outer flow path defined by the first inner shell body to be jetted from the first opening end of the outer shell body.

2. The thrust generating apparatus according to claim 1, further comprising a rotation control unit configured to selectively rotate one of the first fan rotating body and the second fan rotating body.

3. The thrust generating apparatus according to claim 1, wherein the first inner shell body and the second inner shell body are disposed coaxially with the outer shell body.

4. The thrust generating apparatus according to claim 1, wherein the outer shell body has a shape that is surface-symmetrical with respect to a symmetrical surface perpendicular to a direction of an axis of the outer shell body, the first inner shell body and the second inner shell body are disposed to be surface-symmetrical with respect to the symmetrical surface, and the outer surface of the intermediate shell body has a shape that is surface-symmetrical with respect to the symmetrical surface.

5. The thrust generating apparatus according to claim 1, wherein the outer flow paths defined by the first and second inner shell bodies extend away from an axis in a radial direction toward the outside in the axial direction.

6. The thrust generating apparatus according to claim 1, wherein the outer shell body has a bore diameter of the first opening end and a bore diameter of the second opening end larger than an inner diameter of a portion between the first opening end and the second opening end, and each of the first inner shell body and the second inner shell body has a bore diameter of an opening end outside in the axial direction larger than a bore diameter of the opening end inside in the axial direction.

7. The thrust generating apparatus according to claim 1, wherein the intermediate shell body has a shape rotation-symmetrical with respect to an axis of the outer shell body and includes an area having a maximum diameter with respect to a diameter in a direction perpendicular to the axial direction, and the intermediate shell body has a shape with a reduced diameter in the perpendicular direction from the area having the maximum diameter toward the outside in the axial direction.

8. The thrust generating apparatus according to claim 7, wherein, in the intermediate shell body, an angle formed by sides that surround the area having the maximum diameter in a cross-sectional shape along the axis is an angle at which the air flow from the one of the first inner shell body and the second inner shell body flows to deviate toward the outside of the other one of the first inner shell body and the second inner shell body.

9. The thrust generating apparatus according to claim 7, wherein, in the intermediate shell body, an angle formed by sides that surround the area having the maximum diameter in a cross-sectional shape along the axis is an angle at which the air flow from the one of the first inner shell body and the second inner shell body is separated from the outer surface of the intermediate shell body after passing through the area having the maximum diameter.

10. The thrust generating apparatus according to claim 7, wherein the intermediate shell body has a diameter in the area having the maximum diameter larger than a bore diameter of the opening end inside in the axial direction of the first inner shell body and a bore diameter of the opening end inside in the axial direction of the second inner shell body, a diameter of an end portion outside in the axial direction at the first inner shell body side is smaller than the bore diameter of the opening end of the first inner shell body, and a diameter of an end portion outside in the axial direction of the intermediate shell body at the second inner shell body side is smaller than the bore diameter of the opening end of the second inner shell body.

* * * * *